US010704184B2

(12) United States Patent
Ramasco et al.

(10) Patent No.: US 10,704,184 B2
(45) Date of Patent: Jul. 7, 2020

(54) VALVED DISPENSING SYSTEM FOR PRODUCTS IN LIQUID FORM BY INERTIAL CENTRIFUGAL ACTION FOR HOUSEHOLD APPLIANCES

(71) Applicant: WHIRLPOOL S.A., Sao Paulo (BR)

(72) Inventors: Bruno T. Ramasco, Stevensville, MI (US); Guilherme Henrique Manzi, Sao Pedro (BR); Marcelo Araujo Dos Santos, Rio Claro (BR)

(73) Assignee: Whirlpool S.A., Sao Paulo (BR)

( * ) Notice: Subject to any disclaimer, the term of this patent is extended or adjusted under 35 U.S.C. 154(b) by 240 days.

(21) Appl. No.: 15/686,296

(22) Filed: Aug. 25, 2017

(65) Prior Publication Data

US 2017/0350061 A1 Dec. 7, 2017

Related U.S. Application Data

(63) Continuation of application No. 14/470,149, filed on Aug. 27, 2014, now abandoned.

(51) Int. Cl.

| | |
|---|---|
| ***D06F 39/02*** | (2006.01) |
| *D06F 23/04* | (2006.01) |
| *D06F 29/00* | (2006.01) |

(52) U.S. Cl.
CPC ..... *D06F 39/022* (2013.01); *D06F 23/04* (2013.01); *D06F 29/00* (2013.01)

(58) Field of Classification Search
CPC ..... D06F 39/022; D06F 23/04; D06F 29/00
USPC ..... 68/17 A
See application file for complete search history.

(56) References Cited

U.S. PATENT DOCUMENTS

| | | | |
|---|---|---|---|
| 1,795,395 | A | 3/1931 | Hoke |
| 2,748,788 | A | 6/1956 | Duckstein |
| 3,014,358 | A | 12/1961 | Bochan |
| 3,026,699 | A | 3/1962 | Rhodes |

(Continued)

FOREIGN PATENT DOCUMENTS

| | | |
|---|---|---|
| BR | DI7003246-7 | 10/2011 |
| BR | 102013015674 A2 | 7/2015 |

(Continued)

*Primary Examiner* — Tinsae B Ayalew
(74) *Attorney, Agent, or Firm* — McGarry Bair PC

(57) ABSTRACT

A washing machine comprising a cabinet that defines an interior with an access opening. A tank located within the interior. A first rotatable basket is located within the tank and defines a first washing compartment. A tower is rotatable about a rotational axis and is at least partially located within the first rotatable basket. A second rotatable basket defines a second washing compartment and is at least partially located within the first washing compartment and is mounted to the rotatable tower. A motor is drivingly coupled to the rotatable tower. A centrifugal dispensing assembly is coupled to the second rotatable basket. The centrifugal dispensing assembly comprises a first container that defines a first reservoir. A first centrifugal chamber is fluidly coupled to the first reservoir and is located centrifugally downstream of the first reservoir. A second centrifugal chamber is centrifugally downstream of the first centrifugal chamber. A second container defines a second reservoir fluidly coupled with the second centrifugal chamber. An orifice has a valve that fluidly couples the first and second centrifugal chambers.

19 Claims, 6 Drawing Sheets

(56) References Cited

U.S. PATENT DOCUMENTS

| | | | | |
|---|---|---|---|---|
| 3,029,623 | A | 4/1962 | Morey | |
| 3,145,551 | A | 8/1964 | Ziegler | |
| 3,209,560 | A | 10/1965 | Shelton | |
| 3,324,688 | A * | 6/1967 | Hubbard | D06F 13/00 68/4 |
| 3,481,162 | A | 12/1969 | Ziegler | |
| 3,509,741 | A | 5/1970 | Morey | |
| 3,575,020 | A | 4/1971 | Hubbard | |
| 3,648,486 | A | 3/1972 | Rosinski, Jr. et al. | |
| 3,987,652 | A | 10/1976 | Ruble | |
| 4,118,957 | A | 10/1978 | Marcussen | |
| 4,162,621 | A | 7/1979 | Stone | |
| 4,175,409 | A | 11/1979 | Morey | |
| 4,186,573 | A | 2/1980 | Brenner et al. | |
| 4,207,760 | A | 6/1980 | Bochan | |
| 4,225,992 | A | 10/1980 | Morey | |
| 4,338,802 | A | 7/1982 | Ohmann et al. | |
| 4,637,230 | A | 1/1987 | Roberts | |
| 4,637,231 | A | 1/1987 | McMillan | |
| 4,920,770 | A | 5/1990 | Dooley et al. | |
| 5,113,542 | A | 5/1992 | Pastryk et al. | |
| 5,440,903 | A | 8/1995 | Kropf et al. | |
| 5,497,638 | A | 3/1996 | Berkcan | |
| 5,611,221 | A | 3/1997 | Tremel | |
| 5,689,847 | A | 11/1997 | Tremel et al. | |
| 5,784,902 | A | 7/1998 | Pinkowski et al. | |
| 6,460,382 | B1 | 10/2002 | Kim et al. | |
| 7,401,479 | B2 | 7/2008 | Fields | |
| 7,866,191 | B2 | 1/2011 | Turner | |
| 9,404,213 | B2 | 8/2016 | Kappler | |
| 2004/0116267 | A1 | 6/2004 | Mathieu et al. | |
| 2005/0284197 | A1 | 12/2005 | Pinkowski et al. | |
| 2007/0084254 | A1 | 4/2007 | Messina | |
| 2009/0211108 | A1 | 8/2009 | Nehring | |
| 2009/0293203 | A1 | 12/2009 | Hettinger et al. | |
| 2011/0094902 | A1 | 4/2011 | Delehey | |
| 2013/0276483 | A1 | 10/2013 | Ryu et al. | |
| 2013/0312462 | A1 | 11/2013 | Kim et al. | |
| 2015/0059417 | A1 | 3/2015 | Ramasco | |
| 2015/0184326 | A1 | 7/2015 | Pyo | |
| 2015/0211163 | A1 | 7/2015 | Jeon | |
| 2016/0201243 | A1 | 7/2016 | Bergamo | |
| 2016/0222567 | A1 | 8/2016 | Manz | |
| 2016/0289884 | A1 | 10/2016 | Kim et al. | |
| 2019/0186064 | A1 | 6/2019 | Kim et al. | |

FOREIGN PATENT DOCUMENTS

| | | | |
|---|---|---|---|
| BR | 102013018364 | A2 | 8/2015 |
| BR | 102013021866 | A2 | 8/2015 |
| BR | 102013015672 | A2 | 9/2015 |
| BR | 102013027400 | A2 | 9/2015 |
| BR | 102013025343 | A2 | 11/2015 |
| BR | 102014008903 | A2 | 12/2015 |
| BR | 102014010905 | A2 | 12/2015 |
| BR | 102014010908 | A2 | 12/2015 |
| BR | 102014018397 | A2 | 2/2016 |
| CN | 203530690 | U | 4/2014 |
| CN | 203729101 | U | 7/2014 |
| CN | 105220395 | A | 1/2016 |
| KR | 20030045447 | A | 6/2003 |
| WO | 2013088426 | A2 | 6/2013 |
| WO | 2014201534 | A1 | 12/2014 |
| WO | 2015048870 | A1 | 4/2015 |
| WO | 2015058269 | A1 | 4/2015 |

* cited by examiner

VALVED DISPENSING SYSTEM FOR PRODUCTS IN LIQUID FORM BY INERTIAL CENTRIFUGAL ACTION FOR HOUSEHOLD APPLIANCES

CROSS-REFERENCE TO RELATED APPLICATIONS

This application is a continuation of U.S. patent application Ser. No. 14/470,149, filed Aug. 27, 2014, which claims the priority of Brazil Patent Application No. BR 10 2013 021866 9, filed on Aug. 27, 2013, both of which are incorporated herein by reference in their entirety.

FIELD OF THE INVENTION

The present invention refers to a system for dispensing products in liquid form for household appliances, more specifically for vertical shaft washing machines. Thus, the invention intends to propose a solution for dispensing liquid products, more particularly the one obtained by using known dispensers, in addition to not requiring electronic apparatus or device for operation thereof, thus making it versatile and economic.

BACKGROUND OF THE INVENTION

As widely known, nowadays many washing machines are equipped with devices for storing and dispensing products (usually detergents and softeners) which are used to aid washing clothing articles, wherein some of them require that users themselves dispense the products while others perform such process automatically but connecting electrical electronic devices which will then significantly increase equipment costs.

Aiming at providing to the users a low price washing machines with product dispenser, the now Applicant has recently filed a patent application for a product dispensing system which, despite the fact that it operates with no need for user's interference, eliminates installation of specific electronic devices, since same is driven by inertial centrifugal action generated during operation of washing machine itself. Hence, such system described in BR Document 10 2013 015674-4 and illustrated in the attached FIG. 1—essentially comprises a product storage reservoir 11 cooperating with a cover 12 provided with an orifice 13 for supplying said reservoir 11, wherein it also cooperates with a lower reservoir 14, which it also comprises on its rear wall a longitudinal slit 15 for fluid communication with the lower reservoir which, in turn, is in fluid communication with the washing compartment (not shown).

Said system has been proven highly efficient in dispensing products in an economic and simple manner because it is driven by centrifugal force and, therefore, no use of specific electronic device is required. Besides users are not directly required to dispense products in the washing load at a suitable time.

Despite this fact, said system does not allow manufacturers to precisely control the time for a product to be dispensed once the current system is exclusively linked to physical laws and is effect whenever the basket rotation reaches 100 rpm—at this time the product reaches said longitudinal slit 15 and then dispensing of the product begins.

Hence, it is important to emphasize that a precise control of the time at which dispensing would provide several advantages such as, for example, the fact that dispensing is released only at elevated rotations of the washing basket, or after a predetermined amount of rinsing and even centrifugation step is performed.

OBJECTS OF THE INVENTION

Thus, one of the objects of the present invention is to provide a product dispensing system, which although operating by means of centrifugal action (and consequently not acting in conjunction with any electronic device type) permits to have a product dispensing time freely set in function of the needs for use.

Yet another object of the present invention is to provide a product dispensing system by inertial centrifugal action, said system comprising a valve for delivering products, whose curvature point to allow for the passage of the product to washing compartment can be freely controlled.

It is a further object of the present invention to provide a product valved system by inertial centrifugal action which permits to estimate at which rotation intensity of the washing basket the release of the product to the washing compartment will occur.

Still one of the objects of the present invention is to provide a product valved dispensing system by inertial centrifugal action for household appliances, which can be easily handled by users and in addition it autonomously acts without requiring high power consumption.

SUMMARY OF THE INVENTION

A washing machine comprising a cabinet that defines an interior with an access opening. A tank located within the interior. A first rotatable basket is located within the tank and defines a first washing compartment. A tower is rotatable about a rotational axis and is at least partially located within the first rotatable basket. A second rotatable basket defines a second washing compartment and is at least partially located within the first washing compartment and is mounted to the rotatable tower. A motor is drivingly coupled to the rotatable tower. A centrifugal dispensing assembly is coupled to the second rotatable basket. The centrifugal dispensing assembly comprises a first container that defines a first reservoir. A first centrifugal chamber is fluidly coupled to the first reservoir and is located centrifugally downstream of the first reservoir. A second centrifugal chamber is centrifugally downstream of the first centrifugal chamber. A second container defines a second reservoir fluidly coupled with the second centrifugal chamber. An orifice has a valve that fluidly couples the first and second centrifugal chambers.

A centrifugal dispenser comprises a first container defining a first reservoir. A first centrifugal chamber is centrifugally downstream of the first reservoir. A second centrifugal chamber is fluidly coupled to the first centrifugal chamber and is centrifugally downstream of the first centrifugal chamber. A second container defines a second reservoir and is located at least partially below and in fluid communication with the second centrifugal chamber. An orifice fluidly couples the first and second centrifugal chambers. A pressure valve is located within the orifice.

A method of dispensing laundry treating products using centrifugal force. The method comprises retaining by gravity laundry treating products in a first reservoir. Temporarily moving the laundry treating products by centrifugal force from the first reservoir to a first centrifugal chamber. Moving the products from the first centrifugal chamber to a second centrifugal chamber by opening a pressure valve between the first and second centrifugal chamber by centrifugal force acting on the products to open the pressure valve and permit the products to pass through. And, allowing the products to move from the second centrifugal chamber to a second reservoir with gravity.

BRIEF DESCRIPTION OF THE DRAWINGS

The present invention will be described in detail with reference to figures below, wherein.

DETAILED DESCRIPTION OF THE INVENTION

The object of the present invention will be better described in detail with reference to the appended drawings, which are merely exemplificative and not limitative, given that adaptations and modifications can be made without, however, departing from the claimed scope of protection.

The present invention refers to a valved dispensing system for products in liquid form by inertial centrifugal action for household appliances, mainly for storing and dispensing at predetermined rotations detergents and/or fabric softener without requiring installation of any electrical electronic device types.

Figure 8:
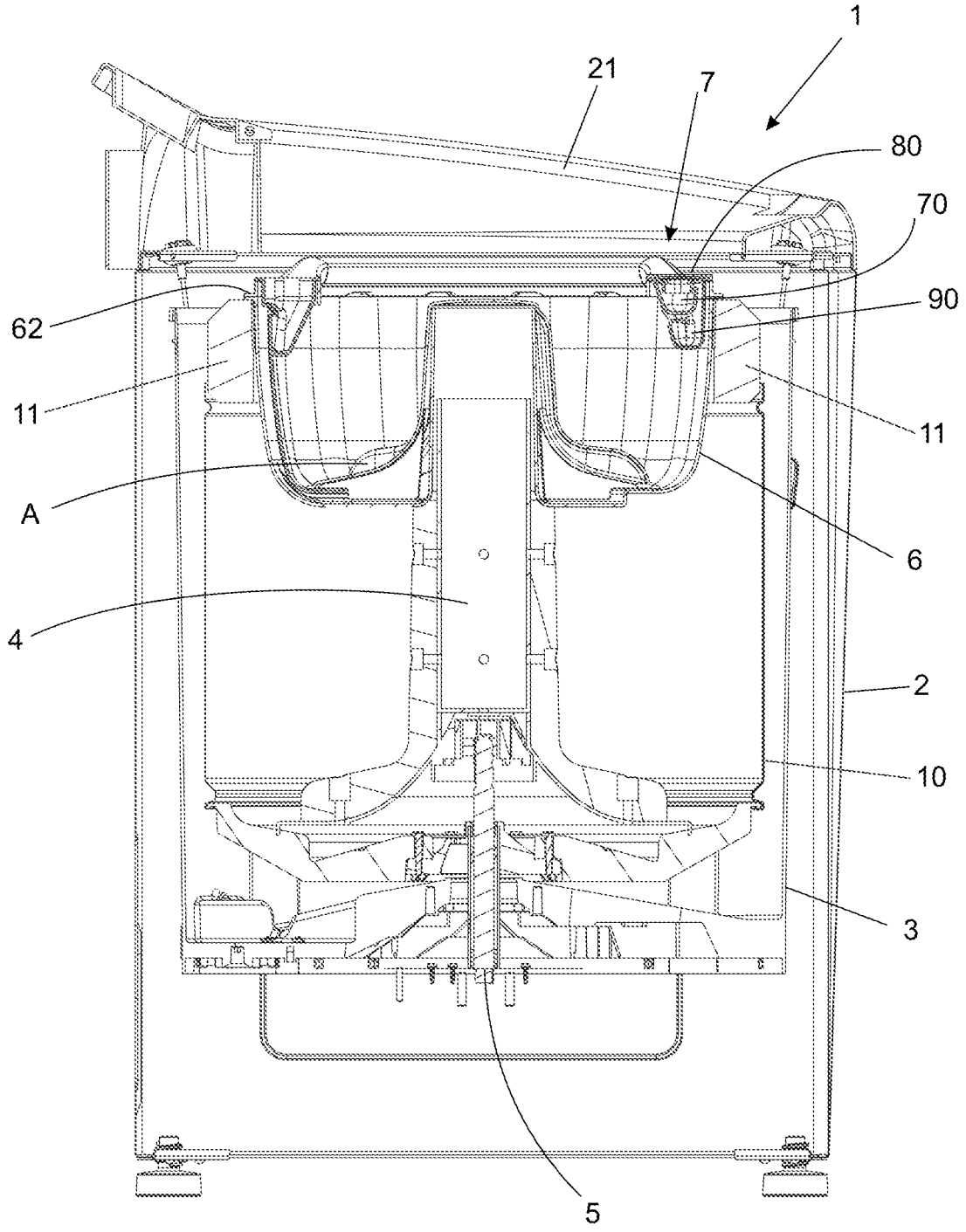
FIG. 8 illustrates a longitudinal section of a household appliance comprising the valved dispensing system for products by inertial centrifugal action for household appliances of the present invention.

To this effect, said system is suitable for washing machines 1 such as, for example, the one illustrated in FIG. 8, which comprises a substantially parallelepipedal housing 2 with a vertical shaft and access cover 21 disposed 10 on the upper surface thereof. In the interior of said housing there is provided a fixed tank 3 cooperating with a movable basket 10 equipped with a balancing device 11, wherein a movable tower 4 cooperates with the movable basket 10 and with the rotor shaft 5 of the device.

Figure 1:
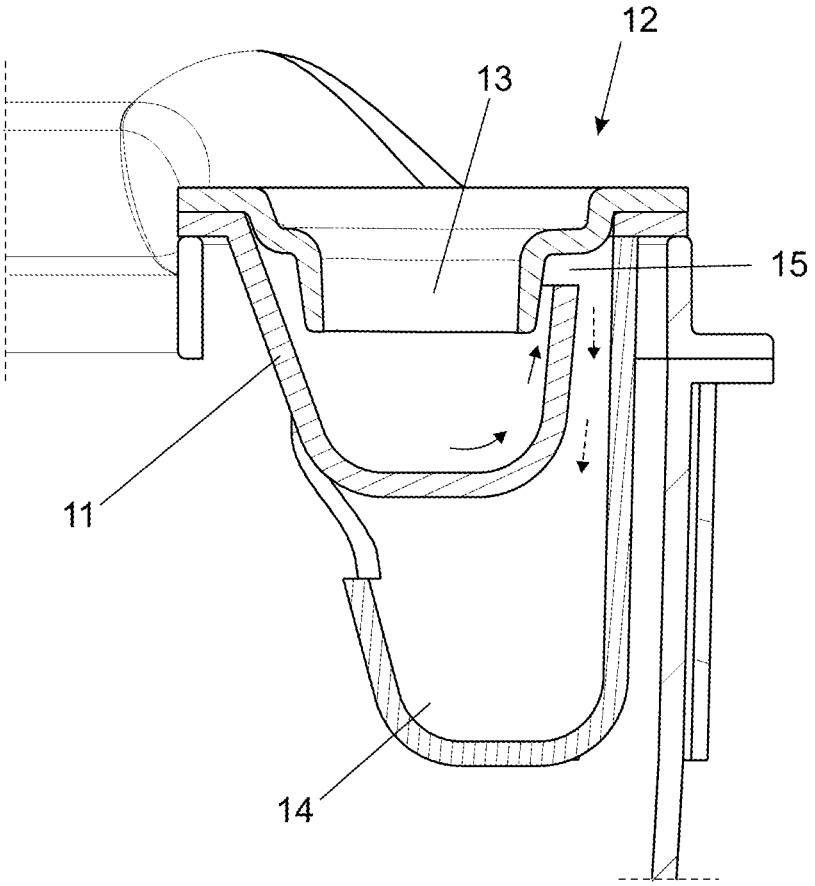
FIG. 1 (PRIOR ART)
FIG. 1 illustrates a cut view of a product dispensing system by inertial centrifugal action according to the state of the art.
Figure 2:
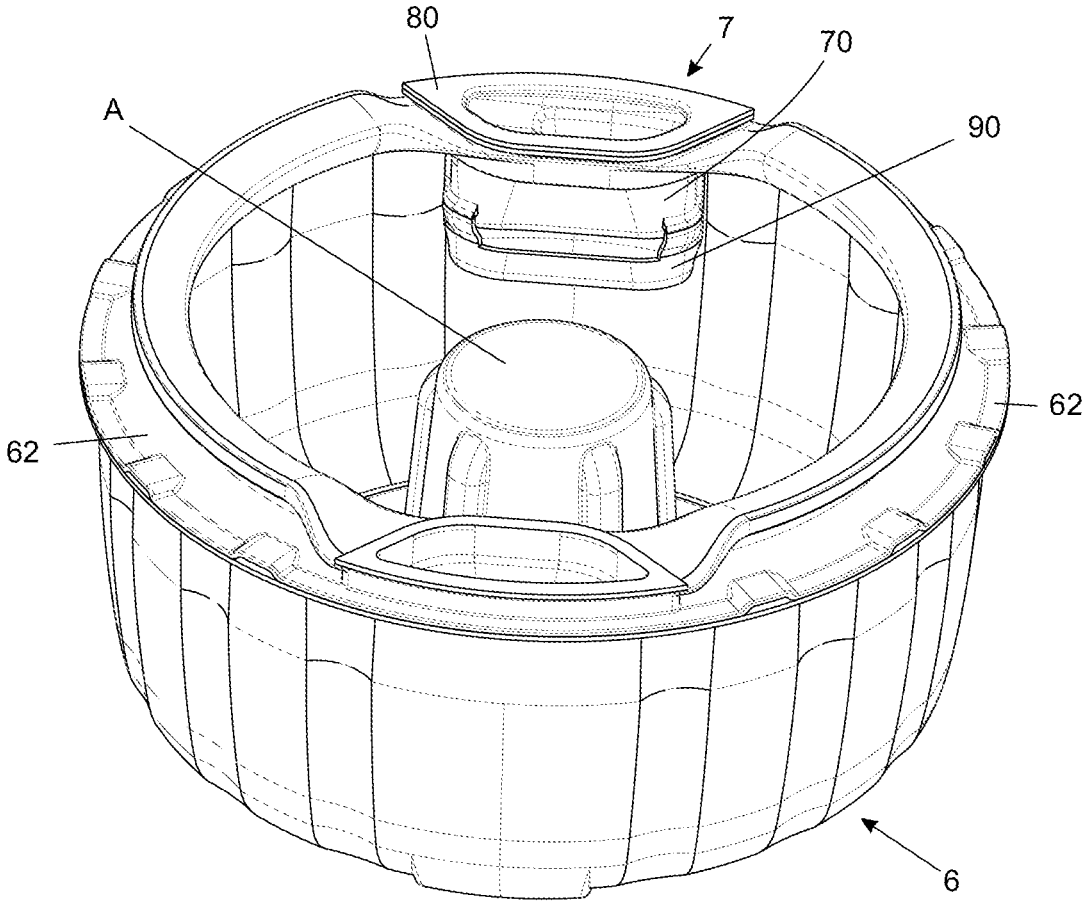
FIG. 2 illustrates a perspective view of a washing compartment for washing machine comprising a preferred embodiment of the valved dispensing system for products by inertial centrifugal action for household appliances of the present invention.
Figure 3:
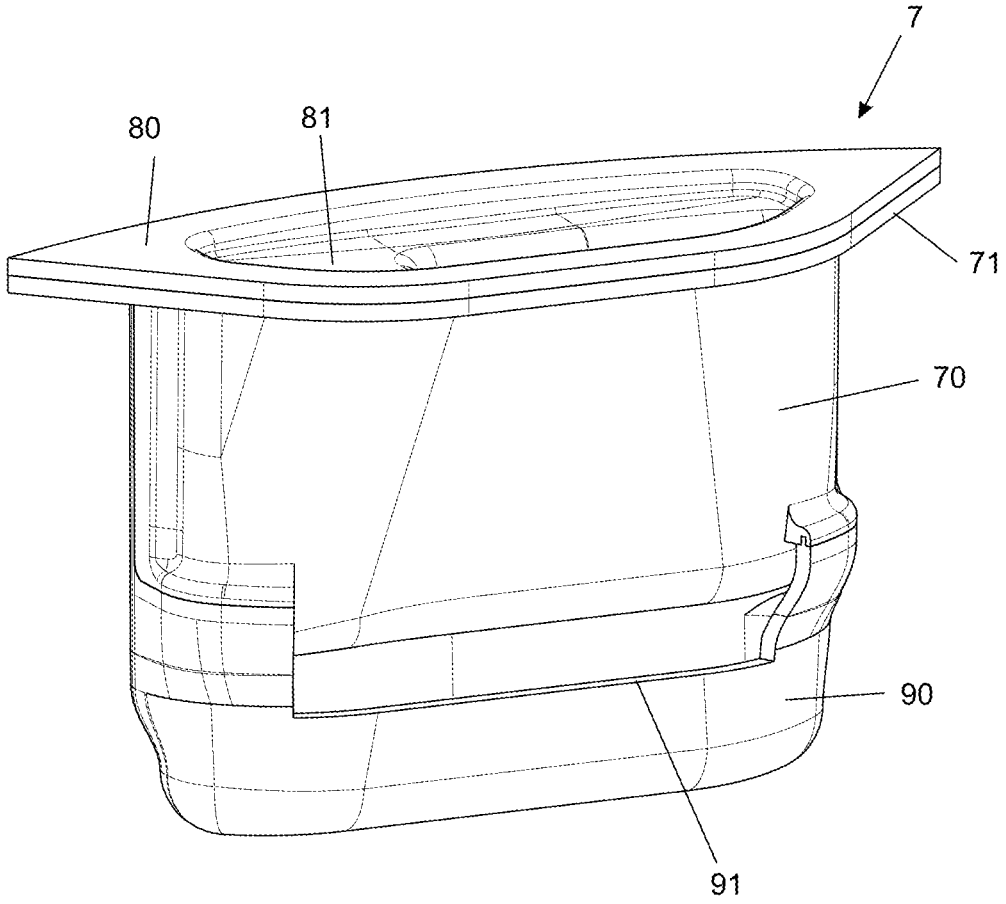
FIG. 3 shows a perspective view of the valved dispensing system for products by inertial centrifugal action for household appliances taken in a form separate from the mounting location.
Figure 4:
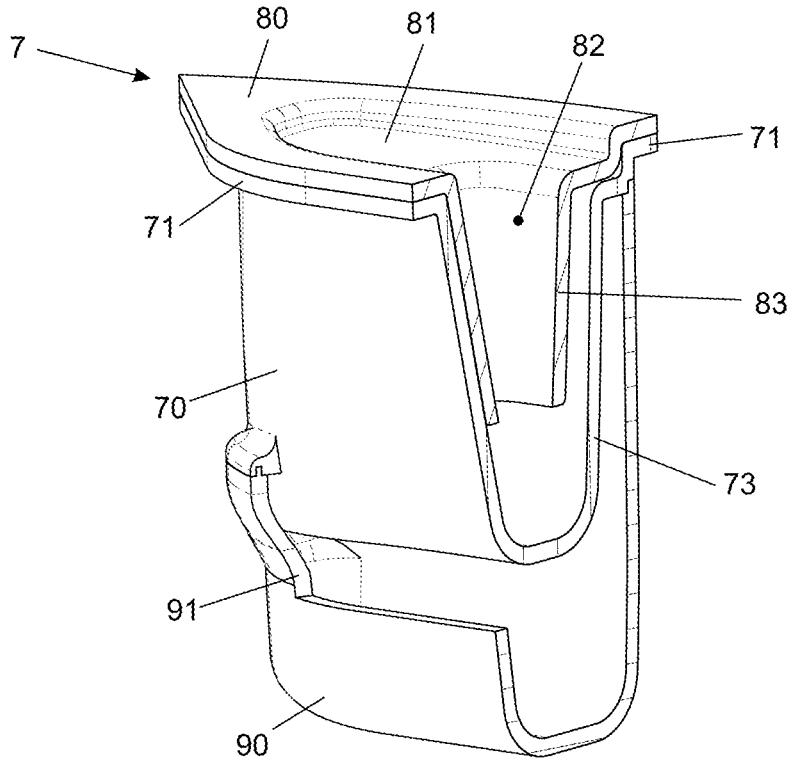
FIGS. 4 and 5 illustrate cross sections of different points of the dispensing system depicted in FIG. 3.
Figure 5:
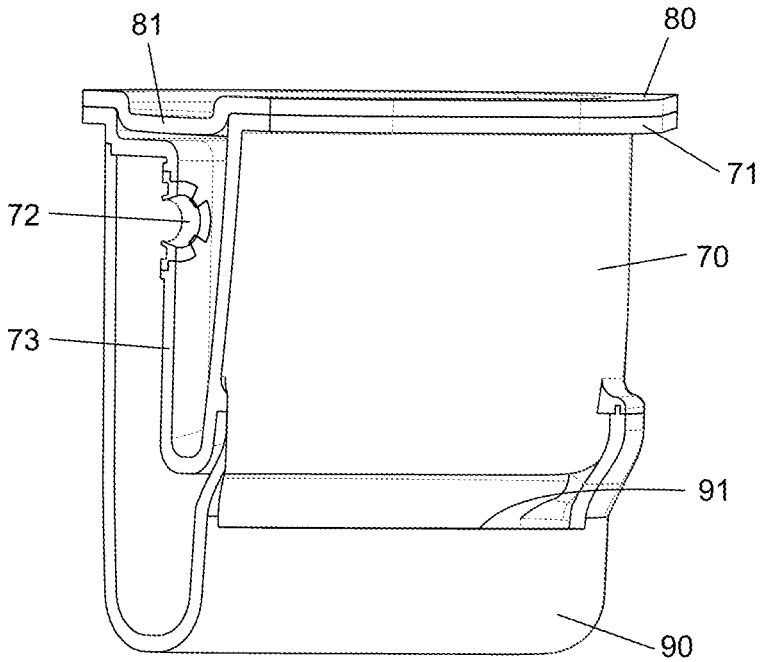
Figure 6:
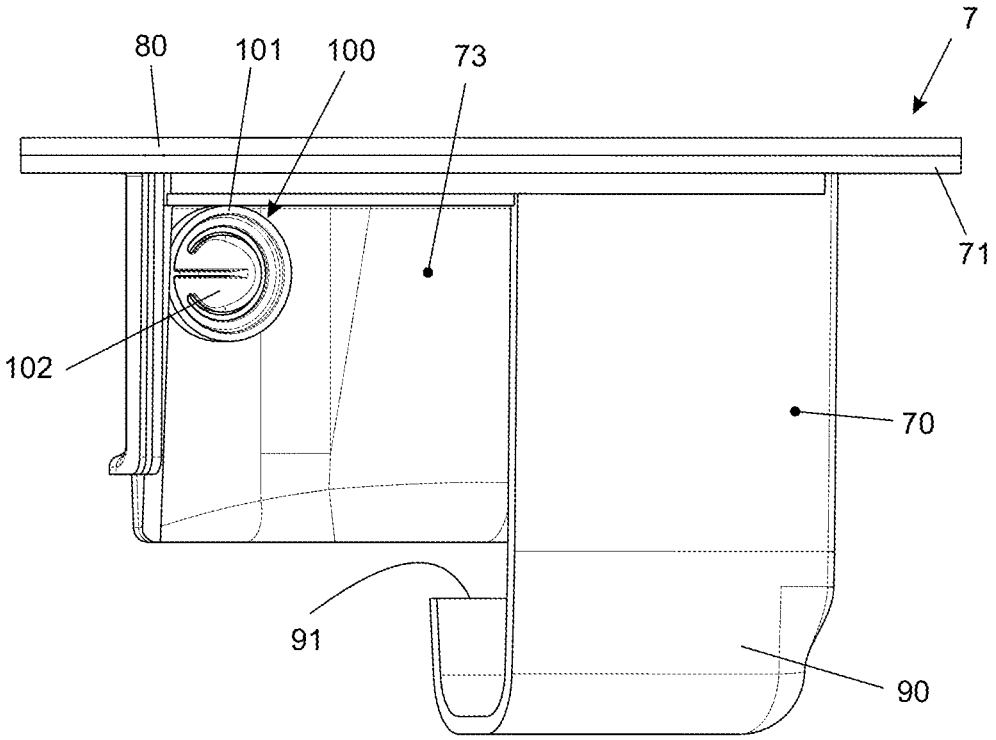
FIG. 6 shows a half-cut view of the system depicted in FIG. 3, permitting to visualize a dispensing valve through the interior of the reservoir.
Figure 7:
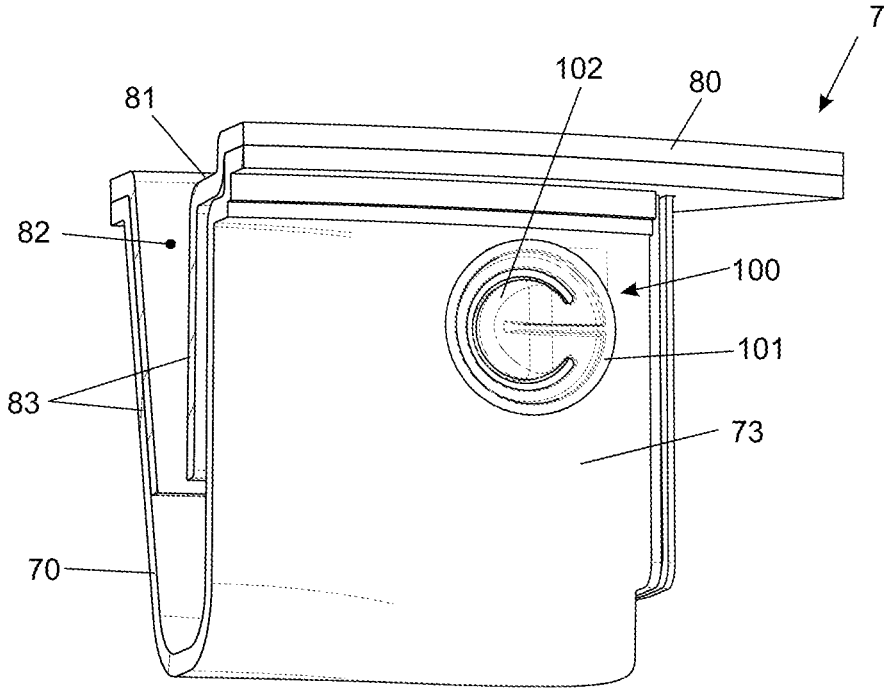
FIG. 7 shows a superior view of an amplified detail of the dispensing system of the present invention.

In an exemplary embodiment illustrated in said FIG. 8, and also in FIG. 2, a washing load to be processed is inserted into an additional compartment 6—which, in this case, is a preferably removable basket defined by a substantially cylindrical body provided with a cylindrical central wall configuring a gap to couple with said movable tower 4, wherein said washing compartment 6 comprises on its upper edge a small perimetral platform 62 which, in addition to aiding to support the washing compartment 6 on the balancing device 11 of the movable basket 10, also cooperates with the valved dispensing system for products 7, which is better illustrated in FIGS. 3 to 6. Further, it should be further clarified that the mounting of said washing compartment in said washing machine 1 is carried out by coupling a concentric agitator A to the washing machine 6 and, consequently, to the movable tower 4.

Hence, it should be pointed out that the valved dispensing system for products 7 can alternatively cooperate with said movable tower 4, agitator A or movable basket 10, and, besides, said system can be solidary with the body of the washing compartment 6 or the movable basket 10, or coupled therewith by an engaging/fixing system aided by any other elements, without departing from the presently claimed scope of protection.

It is important to mention that the present invention also solves the problem of delivering washing products to washing machines comprising more than one washing compartment, particularly in the cases where additional washing compartments 6 are used, wherein the interior of which is not in fluid communication with the movable basket 10, and which is commonly used for delicates or clothes having different colors, for example.

In a preferred embodiment of the present invention illustrated in a more detailed form in FIGS. 3 to 7, said valved dispensing system for products 7 basically comprises a reservoir 70 provided with an upper superior platform 71 and an orifice 72 disposed on its rear wall 73, wherein the lower edge of the upper perimetral platform 71 rests on the perimetral platform 62 of the additional washing compartment 6.

On said platform 71 of said reservoir 70, there is arranged a lowered upper surface 81 comprising an orifice 82 through which a washing product can be delivered to said reservoir 70, wherein said orifice 82 is defined by a perimetral skirt 83.

It is important to emphasize that the main function of said cover 80 is to prevent the washing product from eventually escaping from the edge of said reservoir 70 during rotation of the washing compartment 6 once a centrifugal force created by the equipment mainly during centrifugation steps causes the product to accumulate against the upper peripheral region of the reservoir, such that with no appropriate protection product losses may occur.

Moreover, it may happen that the height of the perimetral skirt 83 of said cover 80 is used as a dosing device through level indication to guide users with respect to the product correct amount to be delivered into the interior of said reservoir 70 to optimize its use and equipment operation.

The valved dispensing system of the present invention further comprises a lower reservoir 90 disposed beneath the reservoir 70, wherein said lower reservoir 90 comprises a slit 91 in the frontal wall to provide fluid communication between the interior of the lower reservoir 90 and the washing compartment 6.

It is important to point out that the use of said lower reservoir 90 is not essential for operating the dispensing system of the present invention; however, its use is advantageous because it avoids that the dispensing of washing product occurs directly over the washing load, which could cause stains on clothes being processed. In addition to this protective aspect, said lower reservoir 90 also comprises a chamber for pre-diluting the product in water, which also favors its use and distribution over the washing load.

The dispensing system of the present invention further comprises a valve 100 defined by a perimetral structure 101 cooperating (in preferably articulated way) with a membrane 102 having a diameter slightly larger than the diameter of said orifice 72 of the reservoir 70 in which said valve 100 will be mounted. Hence, when in a resting position, said membrane 102 keeps the interior of the 10 reservoir 70 closed whereby fluid communication between the reservoir 70 and lower reservoir 90 is avoided.

With regard to this aspect, it should be clarified that the resting position of membrane 102—that is, in a closed condition which prevents fluid passage—keeps the product passage blocked until the washing compartment (6) reaches 15 a determined speed in rotations per minute (rpm), which is defined by many factors relative to the construction of said membrane 102, such as, for example, mass, geometry, rigidity, thickness, constituent material, etc., which shall be appropriately calibrated in function of the speed at which it is desired that same starts releasing the products to be dispensed.

Further, it should be clarified that the preferred embodiment illustrated in the appended drawings shows a membrane 102 having a circular geometry made of rubbery material, nevertheless it should be borne in mind that the same can be made of any other material with the same specified conditions required for appropriate operation of said dispensing system 7—for example, memory metals can be cited. Analogously, said valve 100 can have any geometrical shape provided that the essential features which will determine the sealing movement and release of the channel for product passage are maintained.

It is also important to cite that constituent elements of said dispensing system 7—namely, cover 80, reservoir 70, lower reservoir 90 and valve 100—can be rigidly solidary therebetween or, alternatively, totally or partially removably to facilitate eventual maintenance and cleaning procedures.

Thus, since the system is duly mounted according to what is shown in said figures, users can deposit a suitable product amount in the interior of said reservoir 70 before the washing cycle starts and it should be reminded that product dosing is made through the end of the perimetral skirt 83 of cover 80, or by any other available dosing means (for information purpose only, a recommended amount of softener for a washing load is in this case about 40 ml).

After the machine starts to operate, said washing compartment 6 begins to rotate at variable speeds according the washing process step. As rotation intensity of said washing compartment 6 increases and, therefore, the centrifugal force action occurs, the product stored in said reservoir 70 starts to migrate to the peripheral region thereof to effect an ascending path upon reaching its rear wall. Furthermore, since the equipment rotation is generally always carried out in one same direction (anticlockwise direction), as the rotation of compartment 6 increases the product accumulates in the left rear edge of reservoir 70, exactly in a position in which the orifice 72 is disposed, and in which orifice said valve 100 is mounted.

Further, it should be mentioned that at this time the platform 81 and perimetral skirt 83 of said cover 80 act as means to contain the product, because they form a chamber in which same is stored during high rotation of said washing compartment 6, thus preventing same from leaving and/or escaping from the upper region of the reservoir—which would cause product losses and other drawbacks.

Therefore, the product stored in the interior of said reservoir 70 will remain therein until the rotation speed of compartment 6 reaches a rpm value such that by means of inertial centrifugal force will be able to press membrane 102 of said valve 100 so as to make a gap to allow the product to pass to the rear region of the lower reservoir 90. Further, it should be mentioned that the disclosed system causes the product to change from compartment during the rotation movement of the washing compartment such that as rotation force stops and same loses speed, the product runs through the rear wall of the reservoir 90 until it reaches its lower region, which will be filled with water to dilute the product and as the lower reservoir overflows through the slit 91, the product will be sent to the washing compartment.

After that, completion of next step of filling said washing compartment with water will provide fluid communication between the washing compartment and the interior of said lower reservoir 90, thus delivering the entire product contained therein onto the load being processed.

In the end of the process, said membrane 102 of valve 100 returns to initial position that entirely seals the orifice 72 of reservoir 70 such that the system will be just ready to start a new washing cycle.

A very advantageous aspect of the present invention, which was preferably developed for use with softeners or other liquid products resides in the fact that it allows for several rinsing steps to occur before softener is dispensed to the washing load since it is possible to use a valve 100 which will only permit to release the product contained in the interior of reservoir 70 at speeds above 600 rpm, for example, thus allowing for centrifugation for water removal below this rotation speed so that more rinsing steps can be effected until a decision is made to centrifuge, reaching rotations above 600 rpm such that the product is dispensed.

Thus, a combination between setting of the speed operation during different cycle steps and calibration of the characteristics of valve 100 and, more specifically, of membrane 102, will give great freedom to control the most appropriate time at which the product should be dispensed.

Additionally, it should be pointed out that the dispensing system of the present invention releases the total volume of product in a single step; nevertheless, it is worth to mention that it is possible to use in only one washing machine more than one valved dispensing system, each being designed to release passage for the product at predetermined rotations so as to provide for more dispensing times or eventually making it possible to dispense detergents and softeners at different times. In this aspect, it is important to mention that the system of the present invention operates suitably with liquid soap and softener.

The embodiment depicted in the figures is preferred but not limitative since other construction possibilities can be used without departing from the claimed scope of protection. For example, the system may also be secured to the center of the washing compartment 6 or eventually to some kind of support removably cooperating with the perimetral and central walls of said washing compartment 6, with the movable tower 4 or with agitator A to keep it suspended over the washing load, in which case it would be required to dispose a slit 91 also on the rear wall of reservoir 90.

Furthermore, it should be clarified that in an alternative embodiment of the present invention, the valved dispensing system for products 7 can be optionally used in the movable basket 10 itself without departing from the claimed scope of protection. In addition, attention should be drawn to the fact that same may be used in other types of baskets, irrespective of their sizes, capacities or geometrical shapes without departing from the claimed scope of protection.

Also in an optional embodiment, the system of the present invention can be removed from the washing compartment 6 or from the mounting location provided that in order to avoid any reduction in its efficiency, there are provided means such that same remains rigidly coupled to the support means during operation of the washing machine.

It should be reminded that in the known dispensing system described in the beginning of this specification, same operates without using a valve and, consequently, it does not permit to control the rotation intensity at which products are dispensed. In the present invention, the exact point at which one desires to dispense the product is controlled by merely calibrating said valve 100 to open at determined elevated rotation intensities.

Furthermore, it should be pointed out that the description above is only intended to describe by way of example some preferred embodiments of the present invention. Therefore, those skilled in the art understand that several construction modifications, variations and combinations of the features having the same function substantial in the same form to achieve the same results are still within the scope of protection limited by the appended claims.

The invention claimed is:

1. A washing machine comprising:
- a cabinet defining an interior with an access opening;
- a tank located within the interior;
- a first rotatable basket located within the tank and defining a first washing compartment;
- a tower rotatable about a rotational axis and at least partially located within the first rotatable basket;
- a second rotatable basket defining a second washing compartment and at least partially located within the first washing compartment and mounted to the rotatable tower;
- a motor drivingly coupled to the rotatable tower;
- a centrifugal dispensing assembly coupled to the second rotatable basket comprising:
  - a first container comprising a first wall having a lower end defining at least a portion of a first reservoir; the first wall further comprising an upper end extending above the lower end;
  - a first centrifugal chamber at least partially defined by the upper end of the first wall, fluidly coupled to the first reservoir and located centrifugally downstream of the first reservoir;
  - a second centrifugal chamber located centrifugally downstream of the first centrifugal chamber;
  - a second container defining a second reservoir fluidly coupled with the second centrifugal chamber; and
  - an orifice located in the upper end of the first wall having a valve that fluidly couples the first and second centrifugal chambers.

2. The washing machine of claim 1 wherein the first wall is provided at an angle relative to the rotational axis to facilitate product movement up the first wall during a centrifugal spin.

3. The washing machine of claim 1 wherein the orifice is positioned above the second container.

4. The washing machine of claim 3 wherein the second centrifugal chamber gravity feeds the second container.

5. The washing machine of claim 1 further comprising a cover having an inner wall spaced inwardly from the first wall and defining a skirt.

6. The washing machine of claim 5 wherein the skirt defines a height above a bottom of the first container that defines a dosing level for products.

7. The washing machine of claim 5 wherein the inner wall converges with the first wall above the orifice defining at least a portion of the first centrifugal chamber.

8. The washing machine of claim 5 wherein the cover at least partially defines an opening adapted to receive products.

9. The washing machine of claim 5 wherein the cover is selectively removable from the dispensing assembly.

10. A washing machine comprising:
- a cabinet defining an interior with an access opening;
- a tank located within the interior;
- a first rotatable basket located within the tank and defining a first washing compartment;
- a tower rotatable about a rotational axis and at least partially located within the first rotatable basket;
- a second rotatable basket defining a second washing compartment and at least partially located within the first washing compartment and mounted to the rotatable tower;
- a motor drivingly coupled to the rotatable tower;
- a centrifugal dispensing assembly coupled to the second rotatable basket comprising:
  - a first container defining a first reservoir;
  - a first centrifugal chamber comprising a first wall having a lower end fluidly coupled to the first reservoir and located centrifugally downstream of the first reservoir; the first wall further comprising an upper end extending above the lower end;
  - a second centrifugal chamber located centrifugally downstream of the first centrifugal chamber;
  - a second container defining a second reservoir fluidly coupled with the second centrifugal chamber;
  - an orifice having a valve that fluidly couples the first and second centrifugal chambers; and
  - a cover having an inner wall spaced inwardly from the first wall and defining a skirt.

11. The washing machine of claim 10 wherein the first wall further comprises an upper end extending above the lower end and defining at least a portion of the first centrifugal chamber.

12. The washing machine of claim 10 wherein the first wall is provided at an angle relative to the rotational axis to facilitate product movement up the first wall during a centrifugal spin.

13. The washing machine of claim 10 wherein the orifice is located in the upper end of the first wall.

14. The washing machine of claim 10 wherein the orifice is positioned above the second container.

15. The washing machine of claim 10 wherein the second centrifugal chamber gravity feeds the second container.

16. The washing machine of claim 10 wherein the skirt defines a height above a bottom of the first container that defines a dosing level for products.

17. The washing machine of claim 10 wherein the inner wall of the cover converges with the first wall above the orifice defining at least a portion of the first centrifugal chamber.

18. The washing machine of claim 10 wherein the cover at least partially defines an opening adapted to receive products.

19. The washing machine of claim 10 wherein the cover is selectively removable from the dispensing assembly.

* * * * *